US008517032B2

(12) United States Patent
Urtsev et al.

(10) Patent No.: US 8,517,032 B2
(45) Date of Patent: Aug. 27, 2013

(54) SMOKELESS PIPE

(76) Inventors: Vladimir Nikolaevich Urtsev, Magnitogorsk (RU); Dim Maratovich Khabibulin, Magnitogorsk (RU)

( * ) Notice: Subject to any disclaimer, the term of this patent is extended or adjusted under 35 U.S.C. 154(b) by 502 days.

(21) Appl. No.: 12/988,483

(22) PCT Filed: Apr. 21, 2009

(86) PCT No.: PCT/RU2009/000190

§ 371 (c)(1),
(2), (4) Date: Oct. 18, 2010

(87) PCT Pub. No.: WO2009/134164

PCT Pub. Date: Nov. 5, 2009

(65) Prior Publication Data

US 2011/0036363 A1 Feb. 17, 2011

(30) Foreign Application Priority Data

Apr. 28, 2008 (RU) ..... 2008116282

(51) Int. Cl.
*A24F 47/00* (2006.01)

(52) U.S. Cl.
USPC ..... 131/271; 131/273

(58) Field of Classification Search
None
See application file for complete search history.

(56) References Cited

U.S. PATENT DOCUMENTS

| | | | | |
|---|---|---|---|---|
| 4,945,931 | A * | 8/1990 | Gori | 131/335 |
| 6,854,470 | B1 | 2/2005 | Pu | |
| 2004/0003820 | A1 | 1/2004 | Iannuzzi | |

FOREIGN PATENT DOCUMENTS

| | | | |
|---|---|---|---|
| GB | 2 026 299 | A | 2/1980 |
| RU | 2 067 876 | C1 | 10/1996 |
| RU | 20001 | U1 | 10/2001 |

* cited by examiner

*Primary Examiner* — Michael J Felton
(74) *Attorney, Agent, or Firm* — Ladas & Parry LLP

(57) ABSTRACT

A smokeless pipe comprises a bowl (1), a shank (2), a stem (3) with a bit (4) and an air channel (5) inside of the pipe, which is used for placing a carrier of a nicotine-containing or flavoring agent (10) and a heating unit (7) connected to a power supply (8). According to the invention at least one of elements (7) of a heating unit is arranged in the stem (3) and is shifted to the bit (4). The invention ensures preservation of the health of a pipe smoker while fully simulating the process of smoking.

30 Claims, 4 Drawing Sheets

SMOKELESS PIPE

TECHNICAL FIELD

The invention refers to medicine and medical equipment and is used as a device helping to give up smoking. It can be used in circumstances when the full smoking is not possible, for example, on board a plane or in public places, where smoking is forbidden. Besides, the suggested device allows satisfying smoker's need in nicotine without tobacco burning and accompanying exhaustion of smoke and combustion materials, such as CO, acetone, arsenic benzopyrene, tar and so on hazardous for the smoker and people around him/her.

BACKGROUND ART

The known device is made in the form of a cigarette (US 2004003820). Known device comprises a cylindrical chamber with a scratch-releasable flavor-coated insert with definite aromatic substance, resembling a smoking pipe aroma. A movable brush is placed inside of the chamber, bristles whereto stimulate aroma emission while scratching the insert.

A shortcoming of the known device is poor smoking simulation and unhandliness. It is necessary to constantly move the brush inside of the chamber to get the aroma of burning tobacco, while the outlet of the brush knob is made through the filter, and is placed inside of a "smoker's" mouth. Besides, a user inhales aroma of burning tobacco only, while for the full smoking simulation it is essential to provide at least minimum introduction of nicotine into organism, the lack of which can cause definite psychological and/or physiological discomfort.

There is a known smoking device made in the form of a plastic mouthpiece, connected to a cylindrical body, through which the user can inhale the air (RU 2067876). There is a cavity inside of the body made to arrange a sealed capsule (cartridge), comprising a porous polymer material, saturated with a nicotine-containing substance. As such, may be used fluid nicotine or a mix of nicotine, menthol and ethanol. The body is equipped with elements for opening of the capsule.

A shortcoming of known device is poor smoking simulation. In particular, light and sound effects accompanying smoking are lacking.

A smoking simulation device (U.S. Pat. No. 6,854,470) is made in the form of a cigarette, i.e. has a hollow cylindrical body, in one end a filter is placed, and in the other, there is an electric lamp, connected to a power supply, arranged inside of the body. In front of the filter various aromatic mixes are placed, through which comes the air inhaled by the user. Besides, inside of the body there are magnets, an electrically conducting plate and an integrated module for sound simulation (background music) of "smoking".

A shortcoming of the known device is that it does not allow smoking simulation with a pipe, as it is known that smokers are divided into categories that use for smoking: a) Russian-style cigarettes without a filter (a papirósa), b) cigars, c) cigarettes, d) smoking pipes. So, the known technical solution which simulates smoking very closely cannot satisfy the smokers accustomed to using a pipe for smoking.

The claimed invention is designated for true simulation of smoking based on using a pipe by a smoker.

SUMMARY OF INVENTION

The specified result is achieved by that a smokeless pipe comprises a bowl, a shank, a stem provided with a bit, and an air channel inside of the pipe, which is used for placing a carrier of a nicotine-containing and/or flavouring agent and a heating unit connected to a power supply, meanwhile at least one of the elements of the heating unit is placed inside of the stem and is shifted to the bit.

Preferably the top of the pipe bowl is made rotatable and combined with a mode select switch.

The mode select switch is made in the form of a set of contacts applied on the contacting surfaces of the rotatable and fixed part of the bowl.

Basically the heating unit is connected to a power supply via the mode select switch.

The heating unit can be made in the form of one or several resistive elements.

The heating unit can be arranged inside of the air channel or in the walls of the stem.

The heating unit can comprise resistive elements positioned inside of the bowl and/or the shank.

Basically a carrier of a nicotine-containing and/or flavouring agent is placed in the stem cavity between the shank and the bit.

A carrier of a nicotine-containing and/or flavouring agent can be made in the form of a hygroscopic material saturated with a solution of a nicotine-containing and/or flavouring agent.

Preferably a carrier of a nicotine-containing and/or flavouring agent can be made in the form of a sealed cylinder, which bases are covered with membranes, its inner volume is filled with a hygroscopic material saturated with a solution of a nicotine-containing and/or flavouring agent, and the cavity for its arrangement is provided with opening means of said cylinder.

Besides, a carrier of a nicotine-containing and/or flavouring agent can be made in the form of a sealed cylinder, which bases are covered with membranes, and inside it there is a reservoir with semi-permeable water-repellent walls inside of which a nicotine-containing and/or flavouring fluid is placed.

A carrier of a nicotine-containing and/or flavouring agent can be also placed in the cavity of the shank or the bowl, or in the cavity between the stem and the shank.

Preferably a power supply is arranged in the bowl walls or in the cavity made in the bottom.

Besides, a power supply is made in the form of a disposable or rechargeable battery.

Preferably the pipe is provided with a battery charge indicator.

The air channel connects the bowl, the shank and the stem with a bit, or the shank and the stem with a bit together.

The air channel inside of the pipe is provided with an additional channel connecting it with the atmosphere.

Besides the exit of the air channel to the atmosphere is provided with a portable or a movable cover.

Preferably a carrier of a nicotine-containing and/or flavouring agent is placed between the entry to the additional channel and the bit of the stem.

Basically the pipe is provided with a tobacco burning simulation element, arranged inside of the bowl and connected to a power supply via the mode select switch.

Besides, a tobacco burning simulation element is made in the form of a neon tube fixed inside of the bowl along its perimeter, or in the form of black frosted or transparent glass with light-emitting diodes placed under it inside of the bowl and connected to a power supply via the mode select switch.

Light-emitting diodes can be connected to a power supply with an option of changing their quantity and order of activation.

The pipe can be provided with a visualization element displaying moving smoke flow and connected to a power supply via the mode select switch, and placed on the outer or the inner surface of the bowl facing a user.

Besides, the pipe can be provided with a sound source connected to a power supply via the mode select switch.

Preferably inside of the air channel there is an air movement sensor connected to a power supply via the mode select switch.

Besides, the pipe can be provided with a power supply deactivation element allowing to switch the power supply off after a preset period of time or a preset number of times, when the air goes through the air channel from the bowl to the stem.

The smokeless pipe made with a bowl, a shank, a stem with a bit and the air channel inside of the pipe enables to most truly simulate a pipe used by a smoker for tobacco smoking. Besides, the pipe can be made solid, i.e. forming a single entity of its components, and having no option of their detachment, or portable when the bowl, the shank and the stem are joined together as one embodiment using known fixing and connecting elements.

Placement of a carrier of a nicotine-containing and/or flavouring agent in the air channel enables to discontinue burning of tobacco placed in the bowl of the pipe at the full smoking, and to substitute tobacco burning by the vapors of substances contained in said carrier. In the most general case of execution of said invention a power supply can be connected to the heating unit via using a pushbutton, lever or a sensor switch.

In the most preferable option the pipe is provided with a mode select switch which depending on the user's need can connect to the power supply the tobacco burning simulation element, the sound source or the visualization element of moving smoke flow. The mode select switch can be made in the form of a set of contacts closed in turn applied on the touching surface of the rotatable and the fixed parts of the bowl, or as an integrated circuit, which can comprise required software elements to control power consumers.

A carrier of a nicotine-containing and/or flavouring agent may be placed anywhere along the air channel: in the bowl, in the shank, between the shank and the stem, or in the stem itself. Experimental findings have shown that the fullest smoking simulation is felt by the user, if a carrier of a nicotine-containing and/or flavouring agent is positioned in the stem cavity between the shank and the bit. The heating unit can be also positioned anywhere in the air channel, but the most reasonable from the user's perception is placing the heating unit in close proximity to the stem bit. The heating unit can be made in the form of one or several resistive elements. Meanwhile in particular execution cases the heating unit can be placed in the air channel or in the stem walls. When the heating unit is placed in the walls more, intensive heating of the walls is ensured at relatively low power consumption, but in this case the temperature of the air coming to the user can be reduced. If the heating unit is placed in the air channel, the temperature of the air coming to the user goes up, but the temperature of the stem walls goes down. In some cases it is reasonable to arrange heaters both in the stem walls and in the air channel. Since some users prefer that during smoking simulation the temperature of the bowl or the shank should be higher than the ambient temperature, it is reasonable to provide the pipe with additional heaters arranged inside of the body of the bowl or the shank, or inside of the air channel coming through the above.

A carrier of a nicotine-containing and/or flavouring agent can be made in the form of porous or hygroscopic material saturated with respective solution. Besides, a carrier of a nicotine-containing and/or flavouring agent can be placed inside of an easily-destroyable and removable envelope before it is placed in the pipe.

It is possible to use as a carrier of a nicotine-containing and/or flavouring agent a sealed cylinder, which bases are covered with membranes. In this case it is necessary to provide the pipe cavity with cylinder opening elements enabling the smoker to open a nicotine-containing and/or flavouring agent at the moment it is necessary for the user.

It is possible to use as a carrier of a nicotine-containing and/or flavouring agent a sealed cylinder, which bases are covered with membranes, containing a reservoir with semi-permeable water-repellent walls, inside of which is arranged a nicotine-containing and/or flavouring solution. In this case it is also necessary to provide the pipe cavity for arrangement of a cylinder with opening elements of the above. Besides, the sealing membranes only will be destroyed opening the air passage to the cylinder. When a smoker makes "a drag" on the pipe, the air comes through the semi-permeable water-repellent walls (preventing the fluid from flowing without blocking the air passage) and is saturated with the vapors of a nicotine-containing and/or flavouring agent.

The parameters of the heaters (resistive elements) and current intensities coming through the above are selected further to calculation or experimental findings based on the stem (bit) material and walls thickness in such way that provide the temperature the most comfortable for a user—within the limits of 36.6-50° C.

The position of the heating unit and the carrier of a nicotine-containing and/or flavouring agent relative to each other and their arrangement in the air channel can be made randomly, but the fullest perception of smoking simulation a user gets if said carrier is positioned between the heater and the shank.

Different known power supplies can be used in order to provide operation of the device. However, the most reasonable is to use as a power supply a disposable or a rechargeable battery in order to make the pipe mobile and self-contained. A power supply can be placed in the pipe anywhere, depending on its dimensions. A power supply can be placed in the bowl or in the shank or in the stem. However, since as a rule, the bowl has thicker walls, it is the most reasonable to make cavities inside it to place a power supply—in the walls or in the bottom. When a power supply is provided in the bottom of the bowl, it is unnecessary to place a heater inside it because when a power supply is run, substantial quantity of the heat is emitted.

It is reasonable in particular cases of execution of said invention to provide the pipe with a battery charge indicator in order to make use of the pipe easier. Any indicator may be selected from the known ones, e.g., the one used in cell phones or a signal lamp that starts blinking when the capacity of the battery is reduced. One of light-emitting diodes being part of elements simulating tobacco burning can be used as such signal element.

Taking into account that a smoker can regulate the size of the smoke channel passage section during smoking and thus regulate the volume of the smoke coming at a drag, it is reasonable to provide the pipe with an element able to perform similar function. An additional channel connecting the air channel inside of the pipe with the atmosphere can be such element. The exit of the air channel to the atmosphere is provided with a portable or a movable cover. In this case during smoking simulation a user by changing the passage section of the exit of additional channel to the surface of the pipe can vary the quantity of the air sucked through the main channel.

In particular cases of execution said invention a tobacco burning simulation element can be arranged inside of the pipe bowl in order to ensure fuller smoking simulation. This tobacco burning simulation element can be made in the form of a neon tube, fixed inside of the bowl along its perimeter, and in the other case—in the form of dark, smooth or textured, frosted or transparent glass with light-emitting diodes, placed inside of the bowl under it and connected to the power supply. Light-emitting diodes can be made red and/or yellow in order to make simulation closer to the real one. The light-emitting diodes can be connected to the power supply with an option of changing their quantity and order of activation in order to create a picture on uneven burning inherent to tobacco burning in a pipe. In this case at a "drag" some light-emitting diodes can be activated, while others activated at another one.

The burning simulation element is connected to the power supply via the mode select switch. Due to this the user can choose any mode of operation, which can envisage glow of the simulation element or its deactivation.

The pipe in order to provide more complete smoking simulation is provided with a panel connected to the power supply via the mode select switch reproducing the image of moving smoke flow, placed on the outer or inner side of the bowl facing the user. As such, a plasma panel, a LCD panel or an organic LED display can be used.

The mode select switch enables to activate or deactivate said panel in the same way as the tobacco burning simulation element.

For more complete smoking simulation the pipe is also provided with a sound source connected to the power supply via the mode select switch. The sound source can simulate tobacco burning with distinctive cracking or reproduce depending on the user's taste wash, nightingale's trills or favorite music.

There's the air moving sensor provided anywhere in the air channel depending on the selected mode of operation responsible for activation of a heating unit, and/or a tobacco burning simulation element, and/or sound, and/or moving smoke flow when the air goes through the channel. Then in case when the smoker makes "a drag" the above elements are put into operation in various combinations.

When the pipe is provided with a power supply deactivation element after a preset period of time or after preset number of times when air goes through the air channel from the bowl to the bit, it enables to limit "smoking". In reality the smoking is over when total tobacco in the pipe bowl is burnt out. This fact is observed by the smoker by changing the taste of the smoke coming to him/her through the smoke channel. According to this invention taste characteristics are not changed in the pipe or it is insignificant, therefore it is reasonable to limit smoking simulation either by time or by number of "drags".

The essence of the suggested invention is illustrated by execution examples referred to enclosed drawings and drawings.

DESCRIPTION OF EMBODIMENTS

Figure 1:
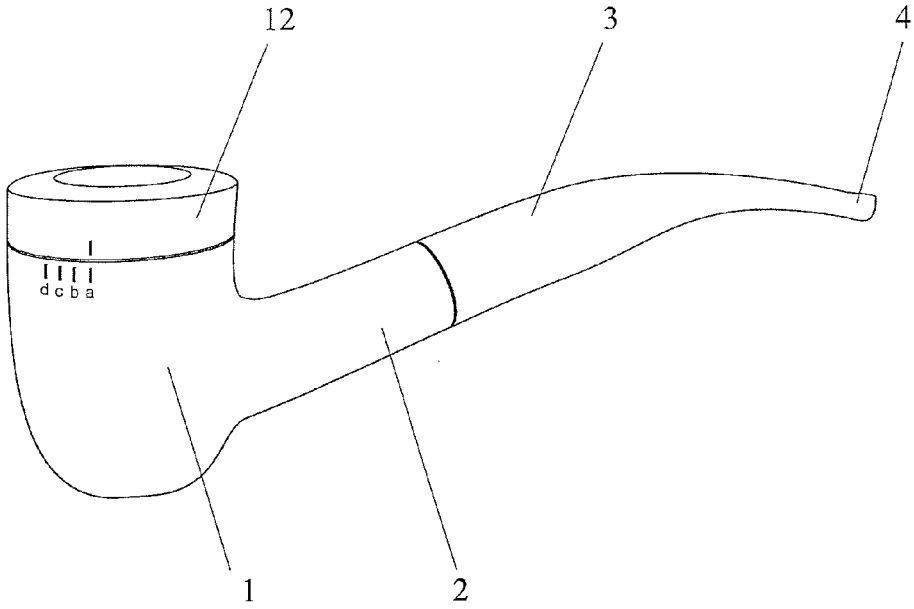
FIG. 1 represents an axonometric view of the pipe.
Figure 2:
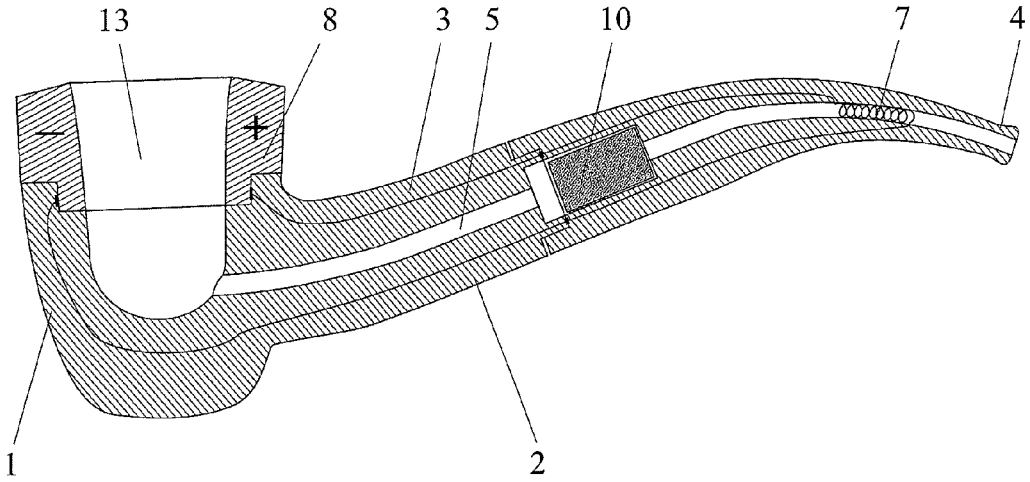
FIG. 2 represents longitudinal section of a pipe option, provided with a carrier of a nicotine-containing or flavouring agent, a heater positioned in the air channel.
Figure 3:
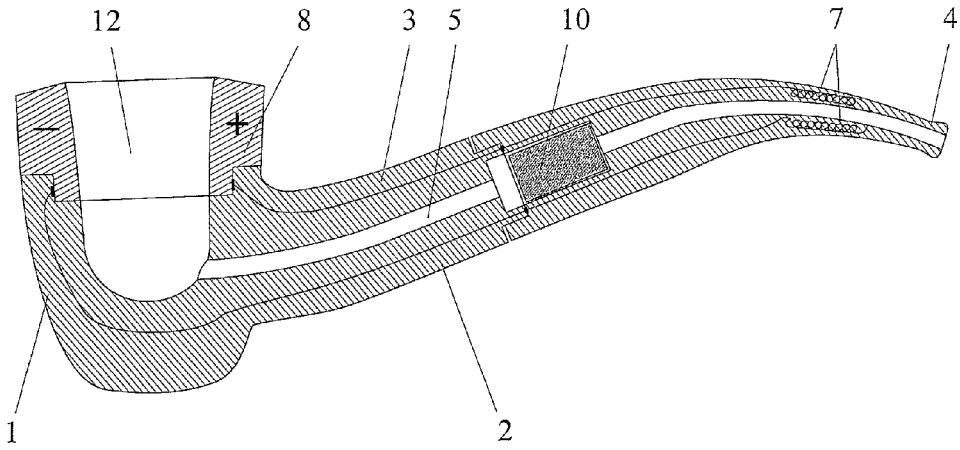
FIG. 3 represents longitudinal section of a pipe option, provided with a carrier of a nicotine-containing or flavouring agent, a heater positioned in the stem walls.
Figure 4:
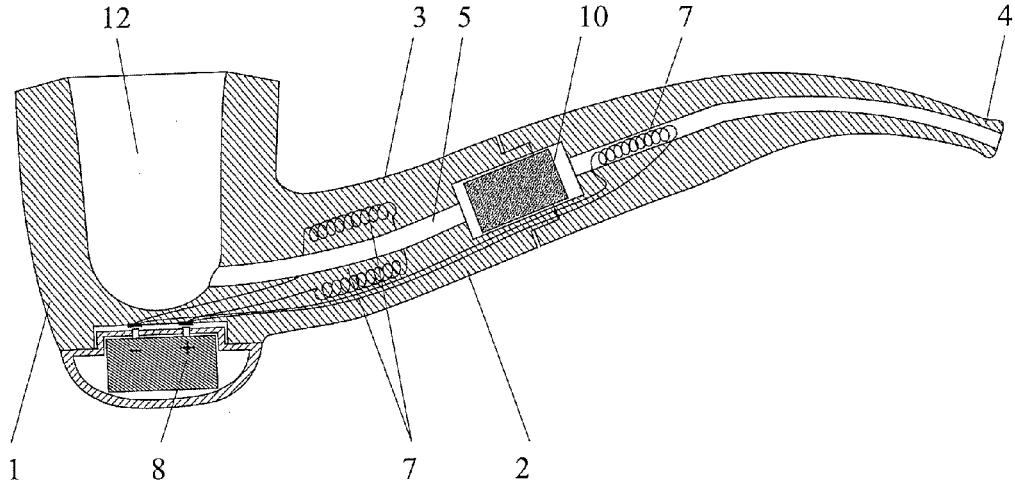
FIG. 4 represents longitudinal section of a pipe option, provided with a power supply in the bottom of the bowl and a carrier with a nicotine-containing or flavouring agent positioned in the cavity between the stem and the shank and heaters, positioned in the shank walls and in the air channel of the stem.
Figure 5:
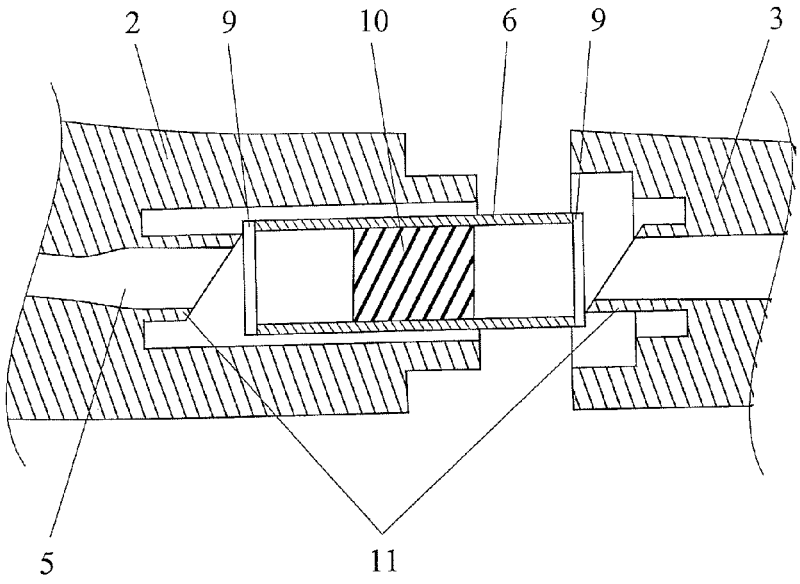
FIG. 5 represents longitudinal section of a pipe fragment with opening elements and a carrier of a nicotine-containing or flavouring agent, made in the form of a sealed cylinder which bases are covered with membranes and positioned in the cavity between the stem and the shank.
Figure 6:
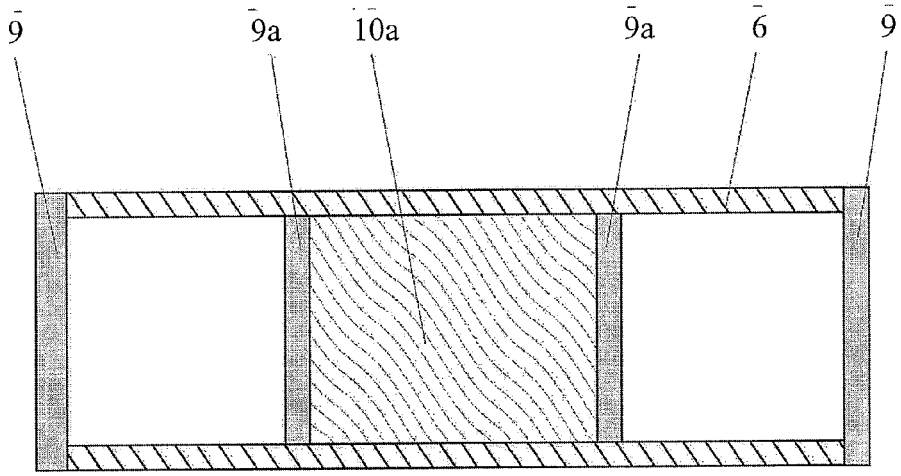
FIG. 6 represents longitudinal section of a carrier of a nicotine-containing or flavouring agent, made in the form of a sealed cylinder with a reservoir having semi-permeable water-repellent walls, inside of which a nicotine-containing or flavouring fluid is placed.

Generally, a smokeless pipe comprises a bowl 1, a shank 2 connected to it, a stem 3 connected to a shank, provided with a bit 4 and general air channel 5. There's a carrier 6 with a nicotine-containing or flavouring agent provided in an air channel 5 of the pipe, and there's a heating unit 7 inside of the stem connected to a power supply 8.

The pipe is used in the following way. A carrier 6 is placed in the air channel 5 of the pipe, after this a power supply 8 is activated by a switch (not shown in the drawings) to a heating unit 7. The following actions of a user depend on the type of a carrier of a nicotine-containing or flavouring agent. If a carrier is made in the form of a porous or hygroscopic material saturated with respective solution and is placed into a easily-destroyable or removable envelope before its placement in the pipe, then after removing of the envelope the user takes a bit 4 of a stem 3 in the mouth and sucks the air through the general air channel 5. Nicotine vapors contained in the carrier go to the user's organism together with the air. If a carrier is made in the form of a sealed cylinder which bases are covered with membranes, which inner volume is filled with hygroscopic material saturated with a nicotine-containing or flavouring solution, or in the form of a sealed cylinder which bases are covered with membranes, with a reservoir having semi-permeable and water-repellent walls, with a nicotine-containing or flavouring fluid, then at first the user opens the cylinder.

In the most preferable option the pipe comprises a bowl 1 with a shank 2, embodied in one piece and a stem 3, detachable from a shank 2, provided with a bit 4 and general air channel 5. There's a carrier 6 with a nicotine-containing or flavouring agent provided in an air channel 5 of the pipe, and there's a heating unit 7 inside of the stem connected to a power supply 8 located in the bottom of a bowl 1. A carrier 6 has of a hollow cylinder shape. The carrier's sealing is provided with membranes 9 positioned on the sides. There's a porous material 10 containing a nicotine or flavouring agent inside of the carrier 6. The cavity provided for the carrier 6 has opening elements 11. In other case, if the carrier 6 is made in the form of a sealed cylinder which bases are covered with membranes 9, with a reservoir having semi-permeable water-repellent walls 9*a*, with a nicotine-containing or flavouring fluid 10*a*, a cavity for the carrier 6 is also provided with opening elements 11.

Top 12 of the bowl 1 is made rotatable. By rotation of the top of the bowl one can switch operation modes of a pipe.

Figure 7:
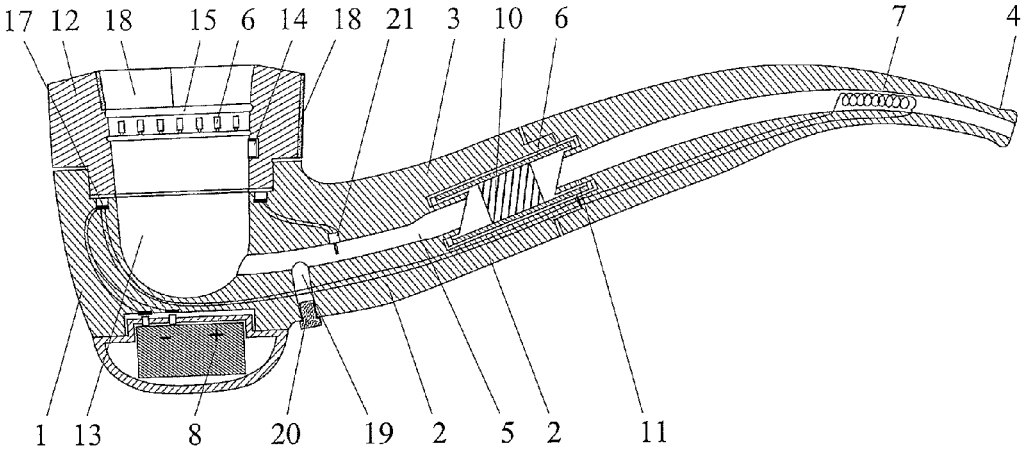
FIG. 7 represents longitudinal section of the most preferable execution option of the pipe.

There's a sound source 14 provided in a cavity 13 of the of bowl 1 and a tobacco burning simulation element containing dark frosted glass 15 with light-emitting diodes 16 provided inside of the bowl 1 and connected to the power supply 8 via a mode select switch 17. There's a visualization element 18 displaying moving smoke flow provided on the outer and/or inner side of the bowl 1, facing the user. The visualization element 18 is a panel displaying moving smoke flow. As such panel any known display means can be used: a plasma panel, a LCD panel or an organic LED display, etc. A general air channel 5, going through the bowl 1, the shank 2 and the stem 3 is provided with additional channel 19, connecting it to the atmosphere (FIG. 7). The channel 19 is provided with a cover 20. A sensor 21 of air movement can be positioned in any suitable place of the air channel 5 connected to a mode select switch 17.

The pipe is provided with an element enabling to deactivate a power supply after a preset period of time or a preset number air passages through the air channel from the bowl to the bit. Said deactivation element is included in an integrated circuit responsible for operation of the mode select switch.

There are four pipe modes of operation envisaged. If the top 12 of the bowl 1 is set in position <<a>>, the power supply 8 is switched off.

When the top 12 of the bowl 1 is switched in position <<b>>, the heating unit 7, a tobacco burning simulation element, a sound source 14 and visualization element 18 of moving smoke flow are connected to the power supply 8 when the air is goes through the air channel 5.

When the top 12 of the bowl 1 is switched in position <<c>>, the heating unit 7 a tobacco burning simulation element, a sound source 14 are connected to the power supply 8 when the air goes through the air channel 5.

When the top 12 of the bowl 1 is switched in position <<d>>, the heating unit 7, a tobacco burning simulation element, a sound source 14 and visualization element 18 of moving smoke flow are connected to the power supply 8 when the air goes through the air channel 5.

The pipe is used in the following way. The stem 3 is detached from the shank 2, and a carrier of a nicotine-containing or flavouring agent 6 made in the form of a sealed cylinder, which bases are covered with membranes 9 is placed into a cavity of the air channel 5. Then the stem 3 and the shank 2 are connected, at this moment a nicotine-containing or flavouring agent is unsealed, as the result of breakage membranes 9 by opening elements 11.

Then the user selects a mode of a pipe operation most suitable for him/her. If mode "a" is chosen, the user just inhales nicotine vapors sucking the air through the air channel 5 and the carrier 6 placed in it.

If mode "b" is chosen, the heating unit 7 and tobacco burning simulation element are activated at the moment when the air goes through the air channel 5. The user inhales the air through the channel 5 which is saturated with nicotine or aroma vapors and heated when goes through the electric heater 7. The tobacco burning simulation element produces a tobacco burning effect in the cavity 13 of the bowl 1 at the moment when the inhaled air goes through, which is read by the air movement sensor 21.

If mode "c" is chosen, at the moment when the user inhales the air through the channel, when the inhaled air passes, which is read by the air movement sensor 21, the heating unit 7, the tobacco burning simulation element and the sound source 14 are activated. The user inhales the air through the channel 5 which is heated going through the heating unit 7 and is saturated with nicotine or aroma vapors going through the carrier 6. The tobacco burning simulation element and the sound source 14 produce a tobacco burning effect in the cavity 13 of the bowl 1.

If mode "d" is chosen, when the inhaled air passes the user activates the heating element 7, the tobacco burning simulation element, the sound source 14 and the visualization element of smoke flow 18.

In all cases the user is enabled to regulate the volume of the air going through the pipe by opening or partly or completely closing the air entry to the additional channel 19.

The pipe enables to truly simulate smoking due to heating of the air and also due to distinctive light and sound effects.

The invention claimed is:

1. A smokeless pipe comprises a bowl (1), a shank (2), a stem (3) with a bit (4) and an air channel (5) inside of the pipe, which is used for placing a carrier (6) of a nicotine- containing or flavoring agent and a heating unit (7) connected to a power supply (8), wherein at least one of elements (7) of a heating unit is arranged in the stem (3) and is shifted to the bit (4).

2. The pipe according to claim 1, characterized in that the top (12) of the bowl (1) is made rotatable and is combined with a mode select switch (17).

3. The pipe according to claim 2, characterized in that the mode select switch (17) is made in the form of a set of contacts applied on contacting surfaces of the rotating and fixed parts of the bowl (1).

4. The pipe according to claim 2, characterized in that the heating unit (7) is connected to the power supply (8) via the mode select switch (17).

5. The pipe according to claim 1, characterized in that the heating unit (7) is made in the form of one or several resistive elements (7).

6. The pipe according to claim 1, characterized in that the heating unit is arranged inside of the air channel.

7. The pipe according to claim 1, characterized in that the heating unit (7) is arranged in the stem (3) walls.

8. The pipe according to claim 1, characterized in that the heating unit elements (7) are positioned inside of the bowl (1) and/or the shank (2).

9. The pipe according to claim 1, characterized in that a carrier (6) of a nicotine-containing or flavoring agent is positioned in the stem (3) cavity between the shank (2) and the bit (4).

10. The pipe according to claim 1, characterized in that a carrier (6) of a nicotine-containing or flavoring agent is positioned inside of the bowl (1) or the shank (2).

11. The pipe according to claim 1, characterized in that a carrier (6) of a nicotine-containing or flavoring agent is made in the form of a hygroscopic material (10) saturated with a solution of a nicotine-containing or flavoring agent.

12. The pipe according to claim 1, characterized in that a carrier (6) of nicotine-containing or flavoring agent is made in the form of a sealed cylinder, which bases are covered with membranes (9), its inner volume is filled with a hygroscopic material (10) saturated with a solution of a nicotine-containing or flavoring agent, and the cavity for its positioning in the pipe is provided with cylinder opening elements (11).

13. The pipe according to claim 1, characterized in that a carrier (6) of a nicotine-containing or flavoring agent is made in the form of a sealed cylinder, which bases are covered with membranes (9), with a reservoir with semi-permeable water-repellent walls (9*a*), with a nicotine-containing or flavoring fluid (10*a*), and the cavity for its positioning in the of pipe is provided with cylinder opening elements (11).

14. The pipe according to claim 1, characterized in that a carrier (6) of a nicotine-containing or flavoring agent is arranged in the cavity between the stem (3) and the shank (2).

15. The pipe according to claim 1, characterized in that a power supply (8) is positioned in the walls of the bowl (1) or in the cavity (13) made in the bottom.

16. The pipe according to claim 1, characterized in that a power supply (8) is made in the form of a disposable or rechargeable battery.

17. The pipe according to claim 16, characterized in that it is provided with a battery charge indicator.

18. The pipe according to claim 1, characterized in that the air channel (5) connects the bowl (1), the shank (2) and the stem (3) with the bit (4) together.

19. The pipe according to claim 1, characterized in that the air channel (5) connects the shank (2) and the stem (3) with the bit (4).

20. The pipe according to claim 18, characterized in that the air channel (5) inside of the pipe is provided with an additional channel (19) connecting it to the atmosphere.

21. The pipe according to claim 20, characterized in that the exit of the additional channel (19) to the atmosphere is provided with a portable or a movable cover (20).

22. The pipe according to claim 20, characterized in that a carrier (6) of a nicotine-containing or flavoring agent is positioned between the entry to the additional channel (19) and the stem bit (4).

23. The pipe according to claim 2, characterized in that it is provided with a tobacco burning simulation element positioned inside of the bowl (1) and connected to the power supply (8) via a mode select switch (17).

24. The pipe according to claim 23, characterized in that a tobacco burning simulation element is made in the form of a neon tube fixed inside of the bowl (1) along its perimeter and connected to the power supply (8) via a mode select switch (17).

25. The pipe according to claim 23, characterized in that a tobacco burning simulation element is made in the form of dark frosted or transparent glass (15) with light-emitting diodes (16) positioned inside of the bowl (1) under it, and connected to the power supply (8) via a mode select switch (17).

26. The pipe according to claim 25, characterized in that light-emitting diodes (16) are connected to the power supply (8) with an option of changing quantity and order of switching.

27. The pipe according to claim 2, characterized in that it is provided with a visualization element (18) displaying moving smoke flow, which is connected to the power supply (8) via a mode select switch (17), and positioned on outer and/or inner side of the bowl (1) facing a user.

28. The pipe according to claim 2, characterized in that a pipe is provided with a sound source (14) connected to the power supply (8) via a mode select switch (17).

29. The pipe according to claim 2, characterized in that air movement sensor (21) is positioned in the air channel (5) connected to the power supply (8) via a mode select switch (17).

30. The pipe according to claim 1, characterized in that it is provided with a power supply deactivation after preset period of time or preset number of times when the air comes through the air channel (5) from the bowl (1) to the bit (4).

* * * * *